US007670658B1

(12) United States Patent
Roberts

(10) Patent No.: US 7,670,658 B1
(45) Date of Patent: Mar. 2, 2010

(54) ANTI-STATIC BALL AND METHOD OF MANUFACTURE

(76) Inventor: James Roberts, #114-2455 Dollarton Hwy, North Vancouver, British Columbia (CA) V7H 0A2

( * ) Notice: Subject to any disclaimer, the term of this patent is extended or adjusted under 35 U.S.C. 154(b) by 336 days.

(21) Appl. No.: 11/899,539

(22) Filed: Sep. 6, 2007

(51) Int. Cl.
*B32B 1/00* (2006.01)

(52) U.S. Cl. ..... 428/36.5; 510/519; 34/389

(58) Field of Classification Search ..... 428/36.5; 34/389, 60; 510/519
See application file for complete search history.

(56) References Cited

U.S. PATENT DOCUMENTS

| | | | |
|---|---|---|---|
| 3,411,498 | A | 11/1968 | Reiter |
| 3,633,538 | A | 1/1972 | Hoeflin |
| 3,706,140 | A | 12/1972 | Brilaud |
| 4,191,178 | A | 3/1980 | Wisnieski |
| 4,532,719 | A | 8/1985 | Davies et al. |
| 4,532,722 | A | 8/1985 | Sax |
| 4,567,675 | A | 2/1986 | Rennie |
| D344,591 | S | 2/1994 | Zhuang |
| 5,413,551 | A | 5/1995 | Wu |
| 5,438,773 | A | 8/1995 | Chaffee |
| D393,671 | S | 4/1998 | Honaker |
| D396,904 | S | 8/1998 | Leu |
| D401,365 | S | 11/1998 | Liu |
| 5,966,831 | A | 10/1999 | Anderson |
| D431,848 | S | 10/2000 | Hubbard |
| D435,660 | S | 12/2000 | Yoo |
| 6,174,577 | B1 | 1/2001 | Vitorino |
| 6,398,127 | B1 | 6/2002 | Wingo |
| 6,432,071 | B1 | 8/2002 | Hsieh |
| 6,574,883 | B2 | 6/2003 | Giblin |
| D478,947 | S | 8/2003 | Lu |
| 6,604,297 | B2 | 8/2003 | Hagemann |
| D516,261 | S | 2/2006 | Roberts |

*Primary Examiner*—Alexander Thomas
(74) *Attorney, Agent, or Firm*—Eric Karich

(57) ABSTRACT

An anti-static ball has a ball housing having a plurality of outwardly extending spikes and a plurality of receivers. A plurality of anti-static foam wafers are mounted on the receivers of the ball housing.

7 Claims, 2 Drawing Sheets

ANTI-STATIC BALL AND METHOD OF MANUFACTURE

CROSS-REFERENCE TO RELATED APPLICATIONS

Not Applicable.

STATEMENT REGARDING FEDERALLY SPONSORED RESEARCH

Not Applicable

BACKGROUND OF THE INVENTION

1. Field of the Invention

This invention relates generally to the dispersion of static within a heated tumble laundry dyer, and more particularly to a reusable, environmentally friendly anti-static ball that prevents the clothing within the dryer from becoming electrically charged.

2. Description of Related Art

The advantages obtained from the use of chemical fabric conditioning agents such as anti-static and fabric softening compounds, either alone or coated on a substrate, for conditioning laundered fabrics are well known in the art. However, a major disadvantage associated with the use of these is the amount of waste that each generates. From discarded plastic jugs and spray bottles, to the plethora of single use anti-static laundry sheets that are discarded after only a one use, the use of these in the laundry leads to a significant amount of waste.

The present invention solves these problems, as well as others associated with the use of these methods, while reducing electrostatic charges that buildup in an automatic heated tumble laundry dryer. The present invention utilizes a unique design that enables it to effectively disperse static break up and physically soften the clothing. Further, the invention, unlike the prior art, is designed to include reusable dispersing agents for anti-static chemicals. Therefore, unlike the prior art, the present invention reduces static build-up and because it is reusable, reduces the amount of waste generated for each load of laundry.

The following art defines the present state of this field:

U.S. Pat. No. 6,174,577, issued on Jan. 16, 2001, to Vitorino, discloses an anti-static ball adapted to be placed in a dyer along with clothes to reduce static buildup. The ball includes a one-piece porous foam ball and a two-piece outer-shell adapted to surround and contain the porous foam ball. The outer shell includes holes to permit communication between the inner foam ball and the clothing.

U.S. Pat. No. 5,002,681, issued on Mar. 26, 1991, to Wierenga et al., discloses fabric softener compositions, delivered by a sheet or pouch, that are included along with the laundry in both the washing and drying cycles. The fabric softener compositions also have anti-static properties.

U.S. Pat. No. 4,057,673, issued on Nov. 8, 1977, to Falivene, discloses a form-retaining substrate coated with a fabric conditioning anti-static compound that is placed amongst damp laundry in an automatic laundry dryer in order to reduce static buildup when the laundry is heated and tumble dried.

U.S. Pat. No. 3,696,034, issued on Oct. 3, 1972, to Hewitt et al., discloses a porous foam substrate coated with a non-ionic fabric softening and anti-static coating compounds, wherein the coating compounds penetrate below the surface of the substrate and into the pores. The coated porous foam substrate is placed amongst damp laundry in an automatic laundry dryer in order to reduce static buildup when the laundry is heated and tumble dried.

The above-described references are hereby incorporated by reference in full.

The prior art teaches the use of anti-static balls and anti-static chemicals. However, the prior art does not teach an effective construction of the anti-static ball along with elements that can disperse anti-static chemicals, and also including physical structures to physically soften the clothing. The present invention fulfills these needs and provides further related advantages as described in the following summary.

SUMMARY OF THE INVENTION

The present invention teaches certain benefits in construction and use which give rise to the objectives described below.

The present invention provides an anti-static ball comprising a ball housing having a plurality of outwardly extending spikes and a plurality of receivers. The anti-static ball also includes a plurality of anti-static foam wafers mounted on the receivers of the ball housing.

A primary objective of the present invention is to provide an anti-static ball having advantages not taught by the prior art.

Another objective is to provide an anti-static ball that is reusable thereby limiting the amount of waste generated for a single load of laundry.

A further objective is to provide an anti-static ball with added physical features that not only disperse static electricity but also physically soften the laundry itself by utilizing the shape of the anti-static ball and an addition of exposed foam wafers that release anti-static chemicals.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an anti-static ball 10 that is adapted to be added to a dryer along with damp clothes to prevent the clothing from becoming electrically charged during the drying process.

Figure 1:
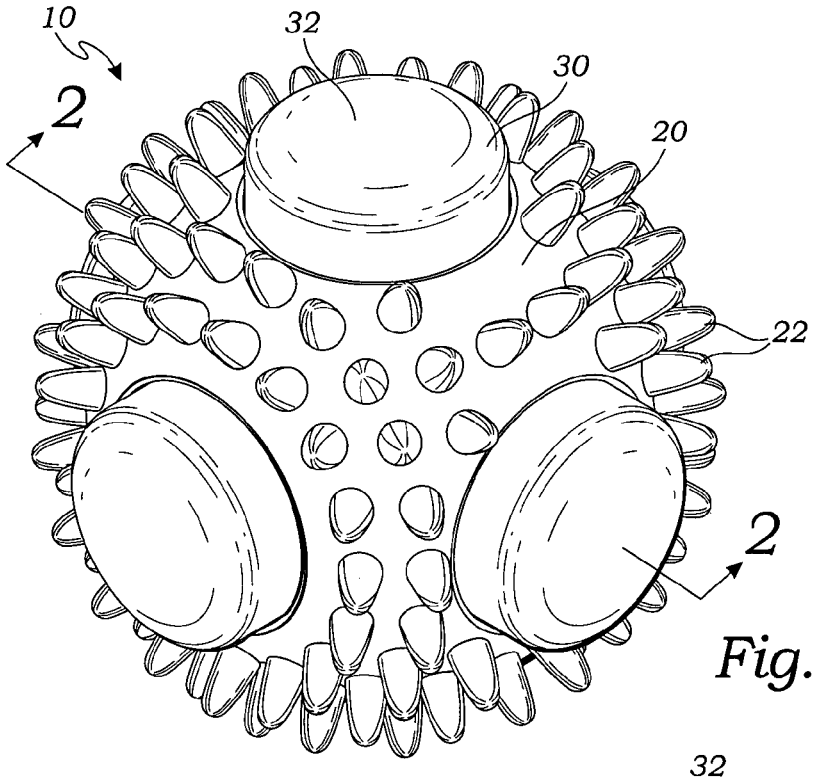
FIG. 1 is a perspective view of an anti-static ball according to a preferred embodiment of the present invention.
Figure 2:
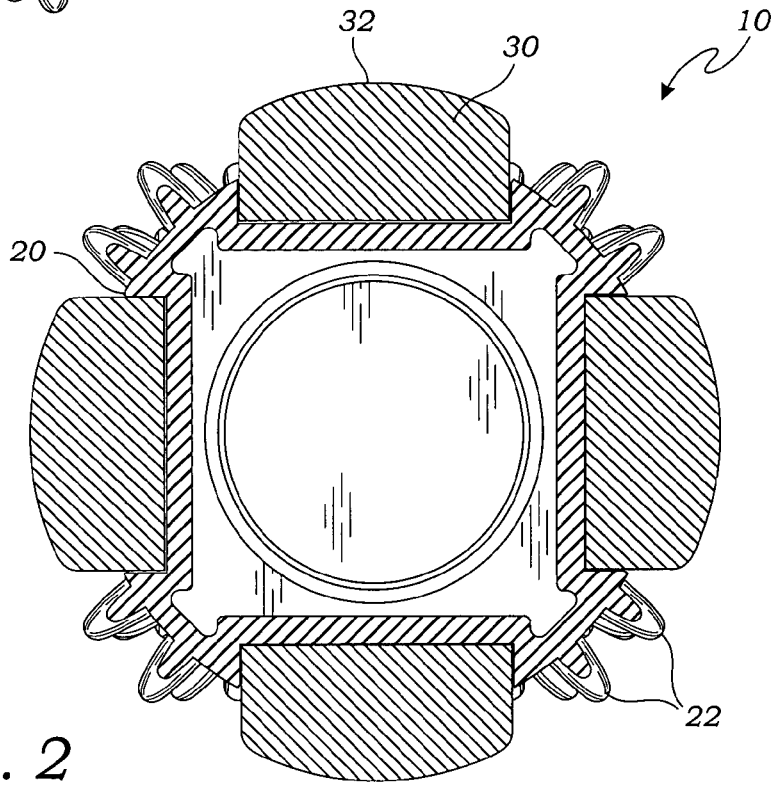
FIG. 2 is a sectional view thereof taken along line 2-2 in FIG. 1.
Figure 3:
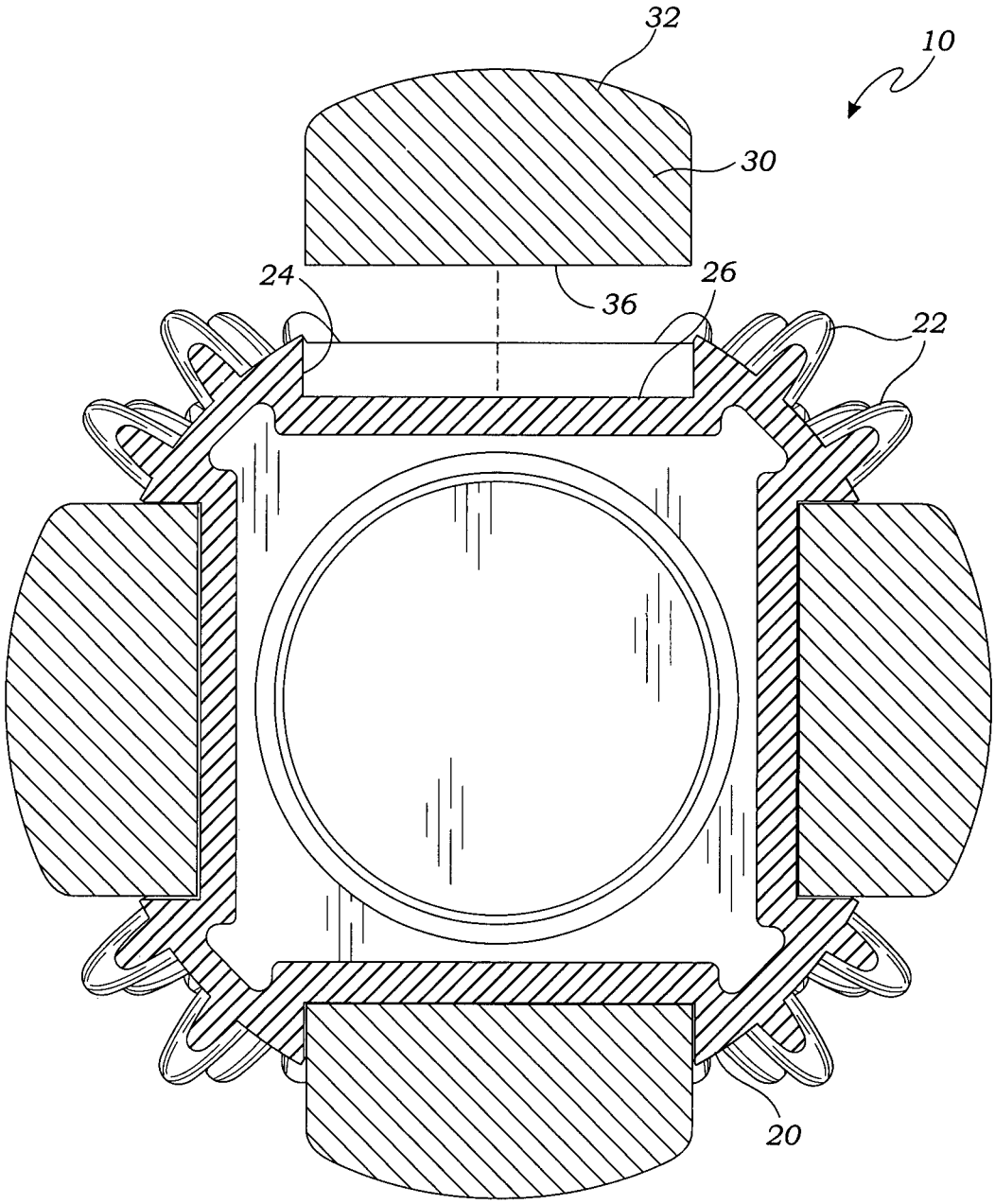
FIG. 3 is an exploded sectional view thereof.

FIG. 1 is a perspective view of the anti-static ball 10 according to a preferred embodiment of the present invention, FIG. 2 is a sectional view thereof taken along line 2-2 in FIG. 1, and FIG. 3 is an exploded sectional view thereof. As shown in FIGS. 1-3, the anti-static ball 10 comprises a ball housing 20 having a plurality of outwardly extending spikes 22 and a plurality of receivers 24 on an outer surface 26 of the ball housing.

The outwardly extending spikes 22 extend from the outer surface 26 of the ball housing 30 and function to physically strike and thereby soften the clothing. The plurality of receivers 24 are each adapted to receive one of a plurality of foam wafers 30, described below. In one embodiment, the ball housing 20 is preferably generally spherical in shape and is preferably made of molded polyvinyl chloride or similar light, non-conductive plastic or other material suitable for this application.

As shown in FIGS. 1-3, the foam wafers 30 preferably include a top surface 32 and a generally planar inner surface 36 that enables the foam wafer 30 to be mounted on one of the receivers 24 of the ball housing 20. In the preferred embodiment, the foam wafers 30 are generally disk shaped, although other shapes may also be used.

The foam wafers 30 include an anti-static compound in a suitable carrier material, preferably polyethylene molded with an anti-static compound to prevent static buildup in the dryer. In the preferred embodiment, the anti-static compound is tallow bis(2-hydroxyethyl)amine; however, any other chemical suitable as an anti-static additive could be used in this application. While the foam wafer 30 is preferably made in part of polyethylene, it may also be made of any other suitable polymer or material.

The present invention also teaches a method for manufacturing the anti-static ball 10 described above. The manufacturing method comprises molding polyvinyl chloride to form the ball housing 20 described above, forming the outwardly extending spikes 22 and the receivers 24. The method further comprises heating the polyethylene to reach a liquid state. In this liquid state, the anti-static compound can be used to dose the polyethylene creating a polyethylene and anti-static compound mixture. The mixture can then be extruded and cut to form the foam wafers 30. Each of the foam wafers 30 is then mounted on one of the receivers 24 of the ball housing 20, using an adhesive, a physical fastener, or other suitable joining or bonding method that can withstand the heat and physical stresses of the dryer.

The foam wafers are positioned such that the inner surface 36 of each foam wafer 30 abuts the outer surface 26 of the ball housing 20. The foam wafers are situated along the outer surface 26 of the ball housing 20 such that each foam wafer 30 can come into physical contact with the clothing (not shown) when placed into a dryer (not shown). This thereby ensures effective transference of the anti-static compound from the foam wafers 30 to the clothing (not shown).

In use, the anti-static ball 10 is added to the heated tumble laundry dryer (not shown) along with a load of damp clothing (not shown). As the laundry is dried, the anti-static ball 10 physically pummels the clothing to soften the clothing, and the anti-static foam wafers 30 remove static buildup.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An anti-static ball comprising:

a ball housing having a plurality of outwardly extending spikes and a plurality of receivers; and a plurality of anti-static foam wafers mounted on the receivers of the ball housing.

2. The anti-static ball of claim 1, wherein the ball housing is generally spherical in shape.

3. The anti-static ball of claim 1, wherein the ball housing is made of polyvinyl chloride.

4. The anti-static ball of claim 1, wherein the foam wafers are made of polyethylene molded with an anti-static compound.

5. The anti-static ball of claim 4, wherein the anti-static compound is tallow bis(2-hydroxyethyl)amine.

6. The anti-static ball of claim 1, wherein the foam wafers are disk shaped.

7. The anti-static ball of claim 1, wherein the foam wafers have a generally planar top surface.

* * * * *